US007891294B2

(12) United States Patent
Yamamoto

(10) Patent No.: US 7,891,294 B2
(45) Date of Patent: Feb. 22, 2011

(54) PRINTING SYSTEM

(75) Inventor: Yoshikazu Yamamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 222 days.

(21) Appl. No.: 11/822,390

(22) Filed: Jul. 5, 2007

(65) Prior Publication Data

US 2008/0134917 A1 Jun. 12, 2008

(30) Foreign Application Priority Data

Dec. 8, 2006 (JP) ..... 2006-332383

(51) Int. Cl.

| | |
|---|---|
| ***B41F 1/18*** | (2006.01) |
| ***B41F 7/00*** | (2006.01) |
| ***B41F 33/00*** | (2006.01) |
| ***B41F 1/54*** | (2006.01) |
| ***B41F 1/66*** | (2006.01) |
| ***B41L 5/12*** | (2006.01) |
| ***B41L 39/00*** | (2006.01) |
| ***B41L 47/56*** | (2006.01) |

(52) U.S. Cl. ..... 101/450.1; 101/484; 101/211

(58) Field of Classification Search ..... 101/450.1, 101/180, 484, 486, 211, 483

See application file for complete search history.

(56) References Cited

U.S. PATENT DOCUMENTS 4,805,501 A * 2/1989 Nuttin ..... 83/300
4,966,352 A * 10/1990 Nuttin ..... 270/1.01
5,043,749 A * 8/1991 Punater et al. ..... 347/130
5,136,316 A * 8/1992 Punater et al. ..... 347/154
5,213,042 A * 5/1993 Larios ..... 101/450.1
6,019,046 A * 2/2000 Rodi ..... 101/479
6,148,724 A * 11/2000 Hart et al. ..... 101/182

FOREIGN PATENT DOCUMENTS

JP A 11-138915 5/1999

* cited by examiner

*Primary Examiner*—Judy Nguyen
*Assistant Examiner*—Leo T Hinze
(74) *Attorney, Agent, or Firm*—Oliff & Berridge, PLC

(57) ABSTRACT

A printing system includes a lithographic plate information printing unit, a variable information printing unit, and a control component. The lithographic plate information printing unit prints lithographic plate information on a recording medium using a lithographic plate. The variable information printing unit prints predetermined variable information on the recording medium on which the lithographic plate information is printed by the lithographic plate information printing unit. The control component controls so that the lithographic plate information to be printed by the lithographic plate information printing unit and the variable information to be printed by the variable information printing unit are printed in preset correspondence with each other.

15 Claims, 13 Drawing Sheets

PRINTING SYSTEM

CROSS-REFERENCE TO RELATED APPLICATIONS

This application is based on and claims priority under 35 USC 119 from Japanese Patent Application No. 2006-332383 filed Dec. 8, 2006.

BACKGROUND

1. Technical Field

The present invention relates to a printing system, a printing device, a controller, a printing method and a storage medium in which a printing program is stored.

2. Related Art

In general, it is desired to print printing information such as characters and images at higher speed. There is a known printer capable of printing variable information as fast as an offset printing device

SUMMARY

According to an aspect of the invention, there is provided a printing system that includes a lithographic plate information printing unit, a variable information printing unit, and a control component. The lithographic plate information printing unit prints lithographic plate information on a recording medium using a lithographic plate. The variable information printing unit prints predetermined variable information on the recording medium on which the lithographic plate information is printed by the lithographic plate information printing unit. The control component controls so that the lithographic plate information to be printed by the lithographic plate information printing unit and the variable information to be printed by the variable information printing unit are printed in preset correspondence with each other.

BRIEF DESCRIPTION OF THE DRAWINGS

Exemplary embodiments of the present invention will be described in detail based on the following figures, wherein.

DETAILED DESCRIPTION

First Exemplary Embodiment

A first exemplary embodiment of the present invention will be specifically described below with reference to the drawings.

Figure 1:
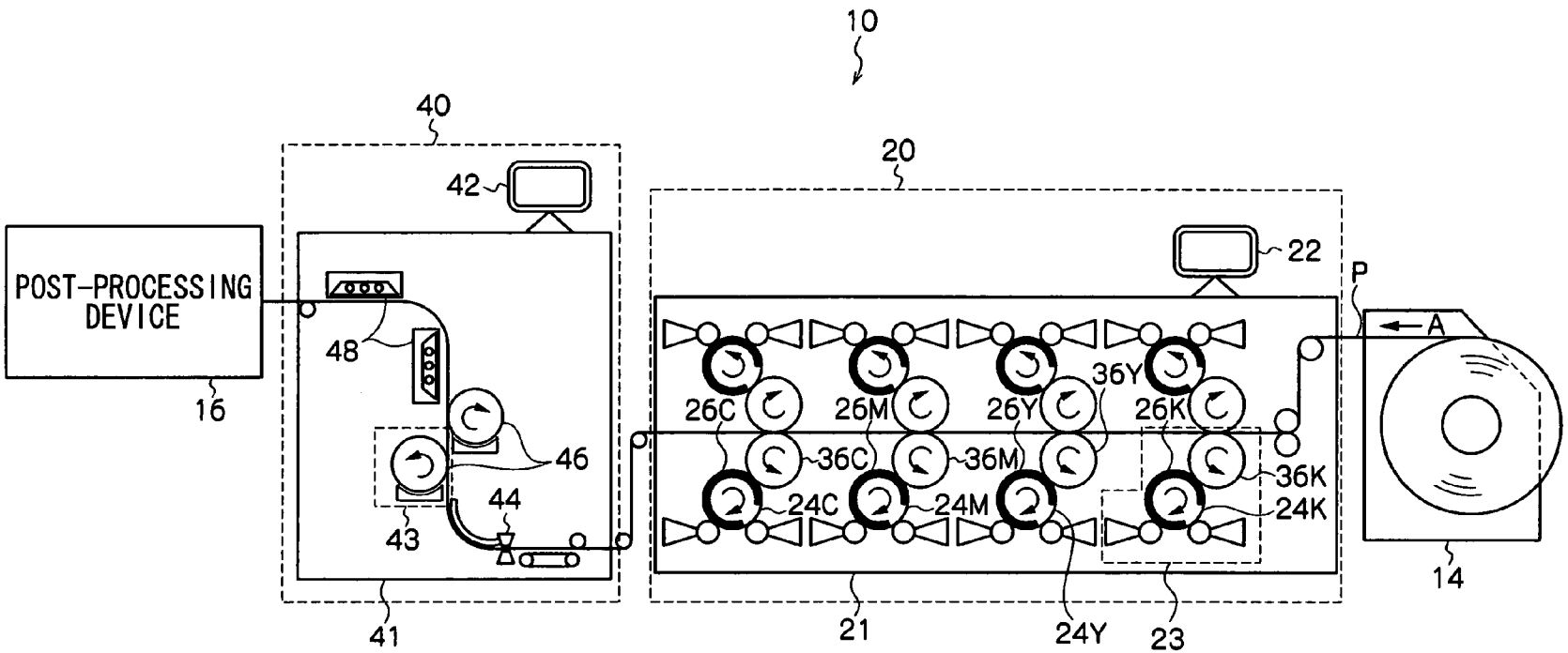
FIG. 1 is a schematic diagram showing a schematic configuration of a printing system according to a first exemplary embodiment of the present invention.

FIG. 1 is a schematic diagram showing a schematic configuration of a printing system 10 according to the exemplary embodiment of the present invention. The printing system 10 includes a paper feed device 14 for feeding paper P in a direction of an arrow A, an offset rotary press 20 for printing fixed data (lithographic plate information, which will be specifically described later) by using lithographic plates 26, a printer device 40 for forming an electrostatic latent image on image holding bodies 46 to print variable data (variable information, which will be specifically described later), and a post-processing device 16.

The offset rotary press 20 includes an operator panel 22 and an offset printing unit 21. The operator panel 22 displays printing information such as an identification code (identification information, which will be specifically described later) of the lithographic plates 26 set currently. In the offset printing unit 21, printing units 23K, 23Y, 23M, and 23C are arranged and disposed from an upstream side in a carrying direction of the paper P so as to successively print images of respective colors, i.e., black (K), yellow (Y), magenta (M), and cyan (C) on a sheet of paper P and carry out color image printing, the respective printing units 23K, 23Y, 23M, and 23C including the lithographic plates 26K, 26Y, 26M, and 26C on which images of the respective colors are formed and which are set on printing cylinders 24K, 24Y, 24M, and 24C, respectively.

Figure 2:
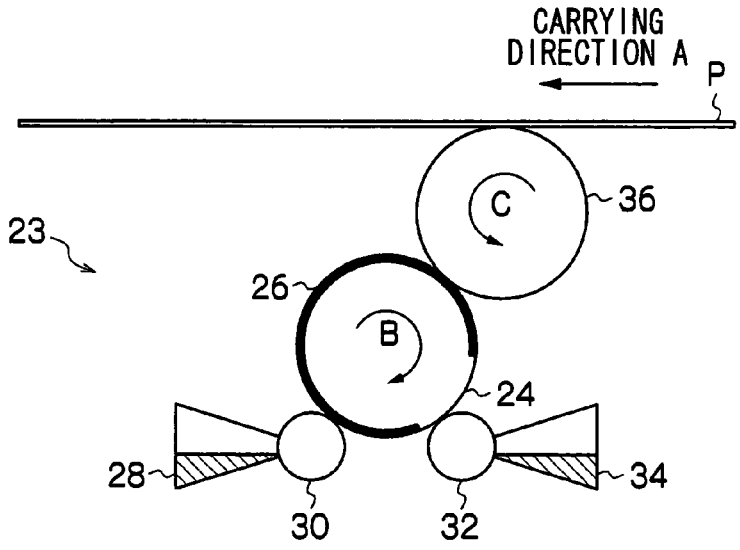
FIG. 2 is a diagram showing a main configuration of a printing unit of an offset rotary press according to the first exemplary embodiment of the present invention.

With reference to FIG. 2, the printing unit 23 will be described. If KYMC need be distinguished from each other, any one of K, Y, M, and C is appended to the end of the reference numeral for description. If KYMC need not be distinguished from each other, K, Y, M, and C are omitted.

In the printing unit 23, an inking roll 30, a dampening roller 32, and a blanket 36 are disposed around the printing cylinder 24 on which the lithographic plate 26 is set, the image of each color being formed on the lithographic plate 26. The image of each color is formed in advance on the lithographic plate 26. The dampening roller 32 dampens non-image areas of a plate face of the lithographic plate 26 with dampening water 34. The inking roll 30 applies oil-based ink 28 to the plate face of the lithographic plate 26. As a result, the oil-based ink 28 adheres only to image areas by the action of water and oil repelling each other. The oil-based ink 28 that has adhered to the plate face of the lithographic plate 26 is transferred onto a surface of the blanket 36 rotating in a direction (rotating direction C) reverse to a rotating direction B of the printing cylinder 24, and the transferred oil-based ink 28 is printed on the paper P. In the printing unit 23 of the next color, the image of the next color is printed in such a manner as to be overlapped on the image printed on the paper P. In the offset rotary press 20 of the exemplary embodiment, the offset printing unit 21 of a so-called BB type is used and the printing units 23 of respective colors are disposed on opposite faces of the paper P (upper and lower sides of the paper P) in order to carry out printing on the opposite faces of the sheet of paper P.

Although the offset rotary press is used in the exemplary embodiment, the printing machine is not limited to this but may be an offset sheet-fed press, a letterpress printing machine, an intaglio printing machine, a stencil printing machine, or the like which can print an image based on fixed data (lithographic plate information, which will be specifically described below) by using lithographic plates.

The printer device 40 includes an operator panel 42 and a printer unit 41. The operator panel 42 displays printing information such as an identification code (identification information, which will be specifically described later) of the lithographic plates 26 set currently in the offset rotary press 20. In the printer unit 41, a detecting sensor 44, image forming units 43 for forming monochrome images (K (black) in the exemplary embodiment) on the paper P, and fixing devices 48 are disposed on opposite faces of the paper P in such a manner as to sandwich the paper P in order to carry out two-side printing.

The detecting sensor 44 is for reading marks made on the sheet of paper P to thereby detect page separations and the like to form the image in registration, for example, in order to print the image of the variable data (variable information, which will be specifically described later) over the image of the fixed data printed by the offset rotary press 20. The detecting sensor 44 is an optical sensor or the like, for example, but is not limited to this. It is essential only that the detecting sensor 44 can read the marks made on the paper P.

Figure 3:
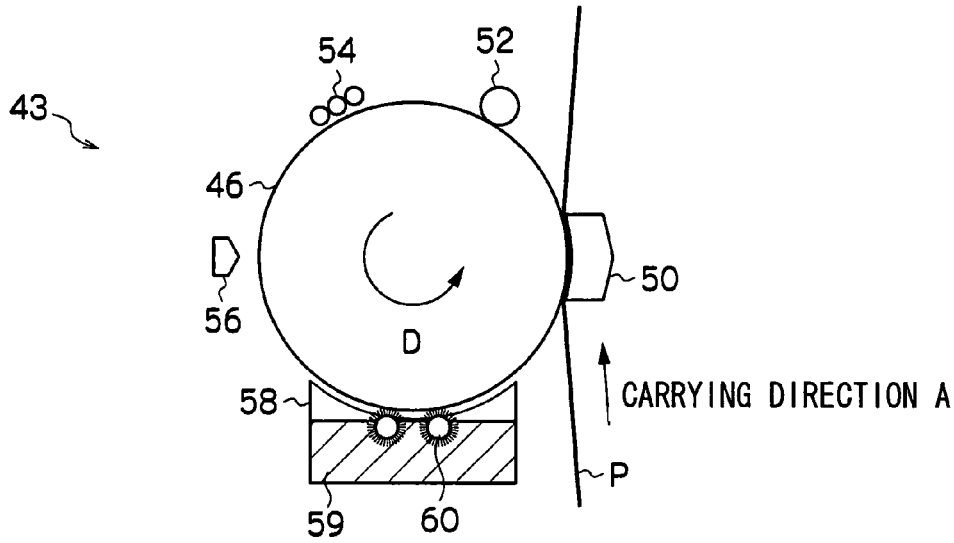
FIG. 3 is a diagram showing a main configuration of an image forming unit of a printer device according to the first exemplary embodiment of the present invention.

With reference to FIG. 3, the image forming unit 43 will be described. In the image forming unit 43, a transfer device 50 for bringing the paper P into contact with the image holding body 46, a cleaner 52, a precharger 54, an exposure LED 56, and a developing machine 58 are disposed around the image holding body 46. The precharger 54 uniformly electrifies a surface of the image holding body 46. The image holding body 46 is rotated at a predetermined speed in a direction of an arrow D by driving by a drive unit such as a stepping motor. The exposure LED line-exposes the surface of the rotating image holding body 46 based on the image data (variable information, which will be specifically described later). As a result, a latent image is formed on the surface of the image holding body 46.

The developing machine 58 applies developing solution 59 including toner and developer to the surface of the image holding body 46 as a roll 60 rotates. Thus, the latent image formed on the surface of the image holding body 46 is supplied with the toner and developed. Then, the transfer device 50 transfers a toner image formed on the surface of the image holding body 46 to the paper P. The cleaner 52 cleans the toner remaining on the surface of the image holding bodies 46.

The fixing machine 48 irradiates the surface of the paper P with flash light. Thus, unfixed toner on the paper P is heated and melted and then is solidified and fixed on the paper P.

The printer device is not limited to the printer device of the type in the exemplary embodiment but may be an ink-jet printer device or the like and may be any printer device which can print the image based on the variable data.

The post-processing device 16 carries out post-processing of the paper P on which the images have been printed by the offset rotary press 20 and the printer device 40. For example, drying, cooling, cutting, and the like of the sheet of paper P are carried out.

Figure 4:
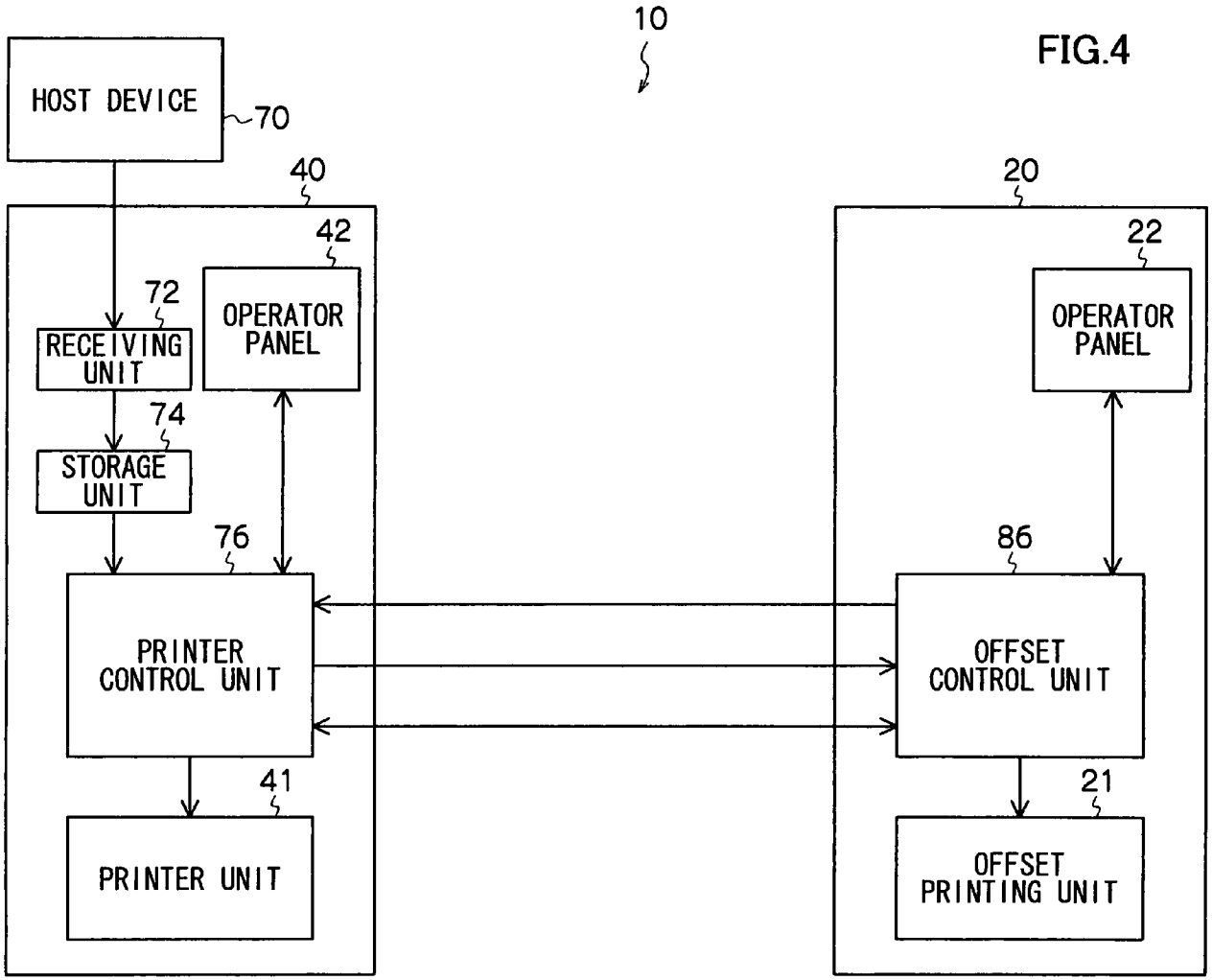
FIG. 4 is a block diagram of a control system of the printing system according to the first exemplary embodiment of the present invention.
Figure 7:
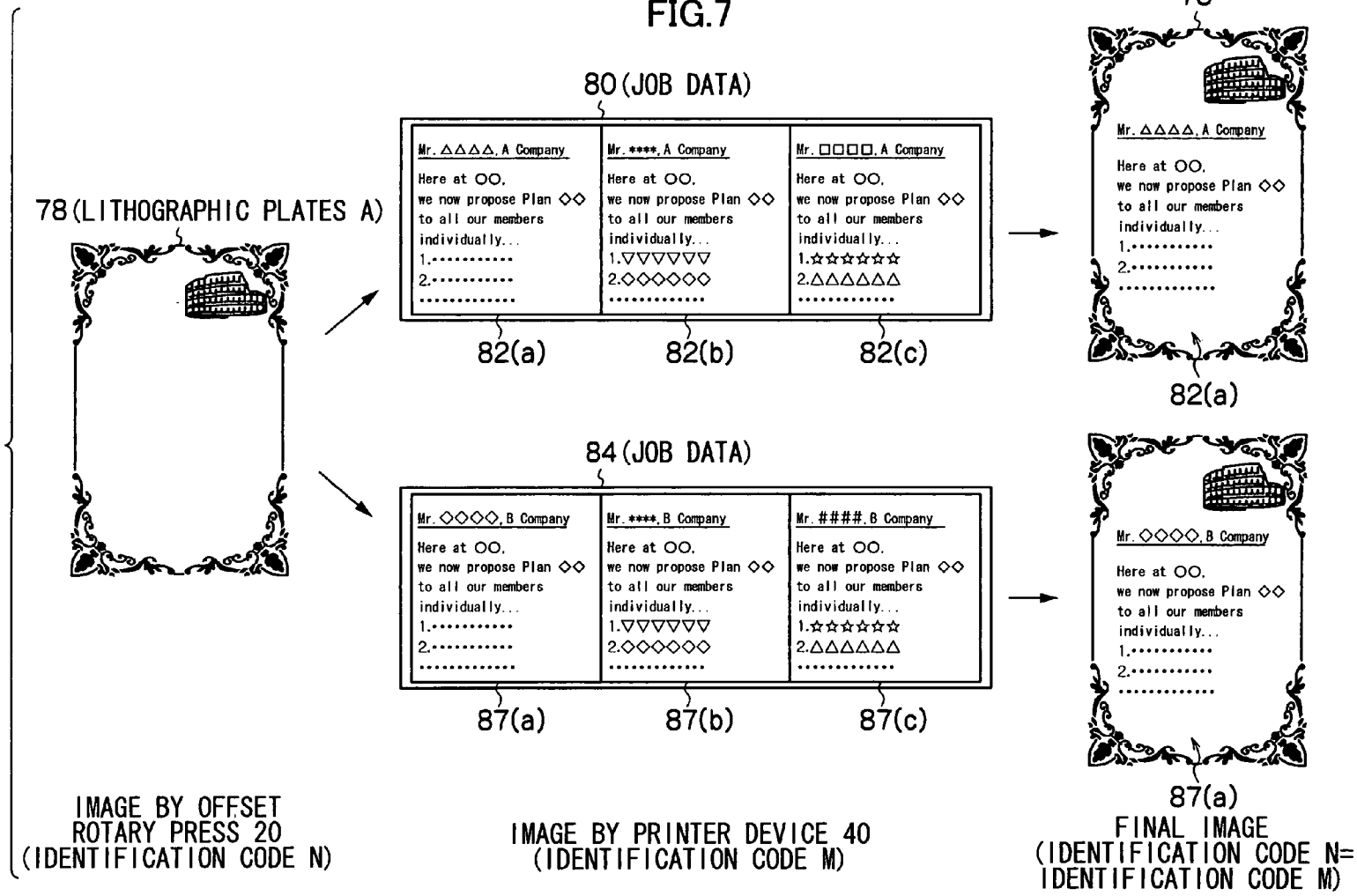
FIG. 7 is an explanatory view for explaining an example of a final image formed by overlapping a fixed data image based on fixed data and a variable data image based on variable data on each other according to the exemplary embodiment of the present invention.

FIG. 4 is a block diagram of a control system of the printing system 10 according to the exemplary embodiment of the present invention. A receiving unit 72 is connected to a host device 70, a storage unit 74 is connected to the receiving unit 72, and the storage unit 74 is connected to a printer control unit 76. The receiving unit 72 receives job data including image data (variable information) and an identification code input from the host device 70, and the storage unit 74 stores the received job data. The exemplary embodiment shows a case where one item of job data is received from the host device 70, e.g., a case where only one of job data 80 and job data 84 in FIG. 7 is received.

An operator panel 42 is connected to the printer control unit 76 for controlling printing operation of the printer device 40 to provide instructions related to printing and the like due to operation by an operator and to give the operator notice of information during printing.

The printer control unit 76 includes a CPU, ROM, RAM, and memory including an HDD. The CPU executes a printer control routine which will be specifically described later. A program of the printer control routine is stored in ROM as the storage medium.

An offset control unit 86 for controlling printing operation of the offset rotary press 20 is connected to the printer control unit 76, and printing information for forming a desired image on the paper P is input and output. Furthermore, the printer unit 41 for printing the image of the variable data on the paper P is connected to the printer control unit 76.

On the other hand, the operator panel 22 is connected to the offset control unit 86 to provide instructions related to printing and the like due to operation by an operator and to give the operator notice of information during printing.

The offset control unit 86 includes a CPU, ROM, RAM, and memory including an HDD. The CPU executes an offset printing control routine which will be specifically described later. A program of the control routine is stored in ROM as the storage medium.

The offset printing unit 21 for printing the image of the fixed data on the paper P is connected to the offset control unit 86.

Figure 5A:
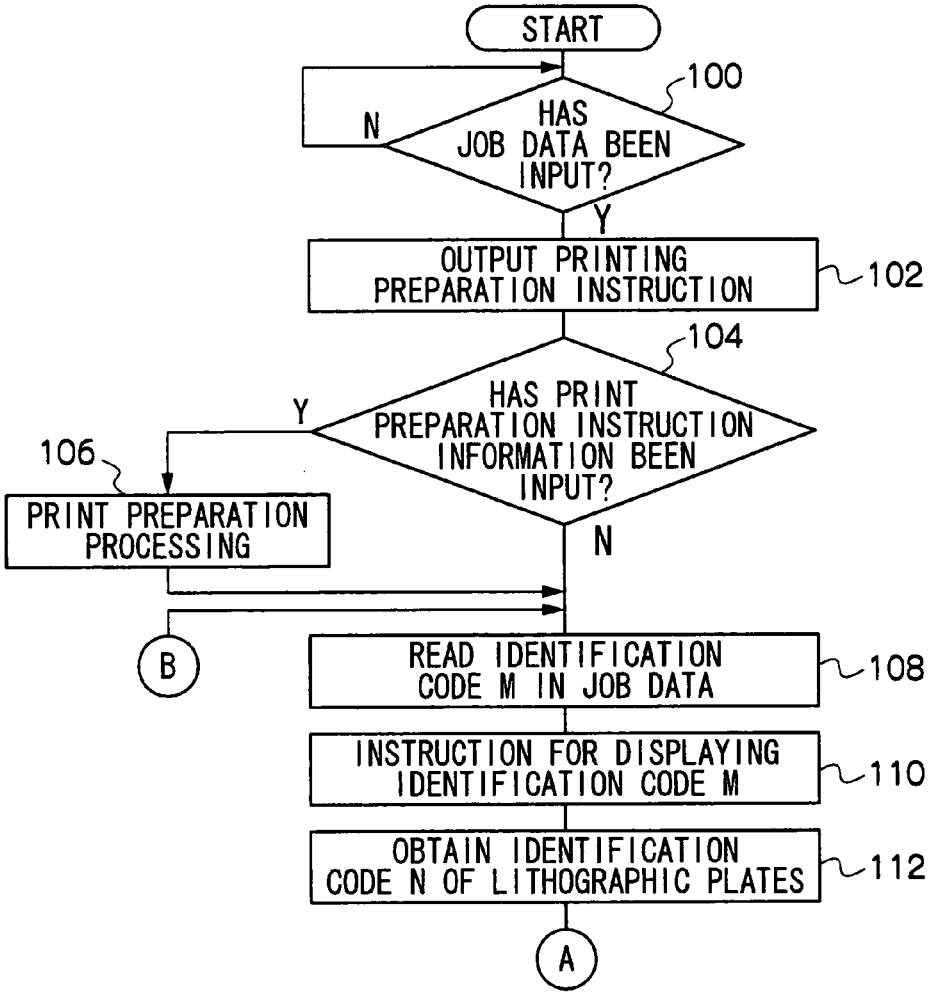
FIGS. 5A and 5B are flow charts of control processing performed by a printer control unit of the printing system according to the first exemplary embodiment of the present invention.
Figure 5B:
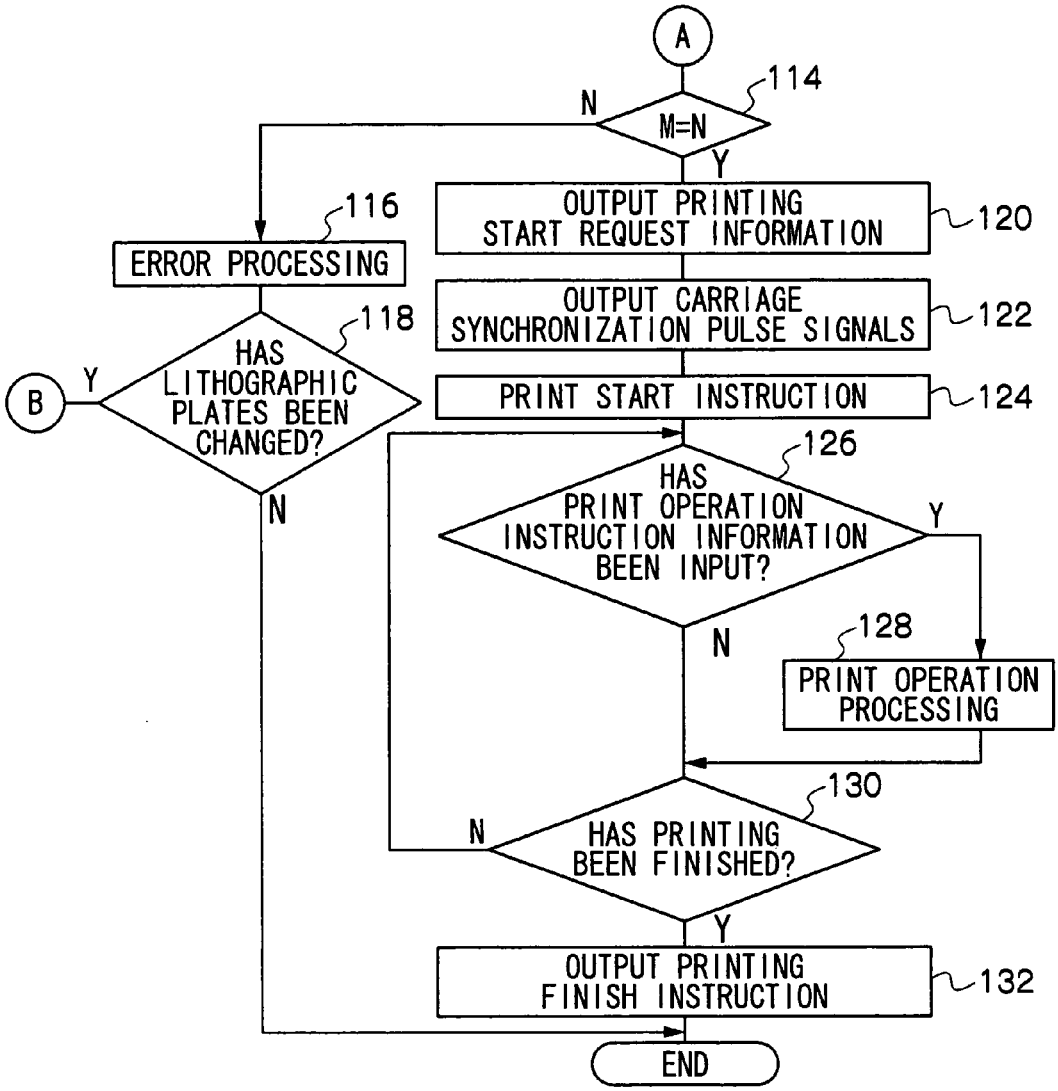

Next, the control routine executed in the printing system 10 of the exemplary embodiment will be described. Pieces of processing shown in FIGS. 5A and 5B are pieces of processing performed by the CPU of the printer control unit 76 and are performed when the printer device 40 is turned on or the job data output from the host device 70 is received by the receiving unit 72, for example.

The image data in the exemplary embodiment will be described. As the image data in the exemplary embodiment, there are two kinds of image data, i.e., fixed data (lithographic plate information) and variable data (variable information). The fixed data is image data for forming the same images on the sheets of paper P in one piece of job printing processing (execution of the control routine), e.g., image data for forming the same image on every page. Specifically, the fixed data is lithographic plate information to be printed by the lithographic plates 26. More specific examples of the image based on the fixed data include a fixed data image 78 (see FIG. 7) and a fixed data image 88 (see FIG. 8).

On the other hand, the variable data is the image data in a case where different images are formed on the sheets of paper P in one piece of job printing processing (execution of the control routine), e.g., a group of different items of image data for forming different images from page to page. More specific examples of the image based on the variable data include the variable data 80 (see FIG. 7) including variable data images 82(*a*), 82(*b*), 82(*c*), variable data 84 (see FIG. 7) including variable data images 87(*a*), 87(*b*), 87(*c*), variable data 90 (see FIG. 8) including variable data images 92(*a*), 92(*b*), and variable data 94 (see FIG. 8) including variable data images 96(*a*), 96(*b*).

First, if an instruction is input to the printer control unit 76, whether or not the job data has been input to the host device 70 is determined in step 100. In case of negative determination, the processing comes into a standby state. If the receiving unit 72 receives the job data and the job data is stored in the storage unit 74, affirmative determination is made and the processing goes to step 102. In step 102, a print preparation instruction is output to the offset control unit 86.

In the next step 104, whether or not print preparation instruction information has been input is determined. The print preparation instruction information in the exemplary embodiment is information for preparation for image forming by the printer unit 41 and for interfacing between printing operation of the offset printing unit 21 and printing operation of the printer device 40. For example, there are ready switch information input from the operator panel 42 and about whether or not the printing preparation has been finished (ready or not ready) based on printer conditions such as a paper jam and running out of paper and pieces of information input from the offset control unit 86 including printing mode switch information indicating whether a mode of printing to be performed is a test printing mode or a normal printing mode and operator panel key operation information for allowing operation of the operator panel 22 to be carried out on the operator panel 42. In case of negative determination, the processing goes to step 108.

On the other hand, if the print preparation instruction information is input, the affirmative determination is made and the processing goes to step 106. In step 106, the processing goes to step 108 in case of ready and is on standby until the not-ready state turns into the ready state in case of not ready if the information is the ready switch information. If the information is the printing mode switch information, the processing goes to step 108 in case of the normal printing mode and is on standby until the test printing mode turns into the normal printing mode in case of the test printing mode. In this way, after the print preparation processing according to each piece of information is carried out, the processing goes to step 108.

In step 108, an identification code M included in the job data is read from the storage unit 74. In the next step 110, the read identification code M is displayed on the operator panel 42 and the operator panel 22. The identification code M may be displayed only one of the operator panels.

In the next step 112, an identification code N of the lithographic plates 26 currently set in the offset rotary press 20 is obtained. In the exemplary embodiment, the lithographic plates 26 are provided with the identification code in advance, and the identification code N is obtained by inputting the identification code N output from the offset control unit 86. The identification code N is not necessarily obtained in this manner but may be obtained by reading the identification code stored in advance in memory or the like by the operator.

In the next step 114, whether or not the identification code M and the identification code N agree with each other is determined. In case of negative determination, the processing goes to step 116 where error processing is carried out. The error processing is processing for bringing the printing operation of the printer device 40 into a standby state and displaying the fact that the identification codes are different on the operator panel 22 of the offset rotary press 20 in order to give the user notice that the identification codes are different, for example, in the exemplary embodiment. Although the fact that the identification codes are different is displayed on the operator panel 22 in the exemplary embodiment, it is also possible to dispose a speaker or the like to give notice by means of voice. It is also possible to give the user notice not only that the identification codes are different but also that the identification codes agree with each other.

In the next step 118, whether or not the lithographic plates 26 set in the offset rotary press 20 have been changed is determined. It may be determined that the lithographic plates 26 have been changed by obtaining information to the effect that the lithographic plates 26 have been changed from the offset control unit 86 or when a predetermined time has elapsed on a timer or the like. If the lithographic plates 26 have been changed, the determination is affirmative and the processing returns to step 108 where it is determined again whether or not the identification code M of the job data and the identification code N of the lithographic plates 26 agree with each other. In case of negative determination, on the other hand, the present processing is finished.

In case of affirmative determination in step 114, on the other hand, the processing goes to step 120. In step 120, printing start request information is output to the offset control unit 86. In the exemplary embodiment, the printing start request information is information for requesting a start of printing of the fixed image on the paper P by the offset rotary press 20.

In the next step 122, carriage synchronization pulse signals are output to the offset control unit 86 in order to equalize a printing speed by the offset rotary press 20 and a printing speed by the printer device 40 with each other. The carriage synchronization pulse signals are signals for equalizing the printing speed of the offset rotary press 20 with the printing speed of the printer device 40, and the speeds are equalized with each other by counting the number of pulses per unit time. Although the speed of the offset rotary press 20 is equalized with the speed of the printer device 40 in the exemplary embodiment, it is also possible to equalize the speed of the printer device 40 with the speed of the offset rotary press 20. Which one of the speeds the other should be equalized with is preferably determined based on the respective printing speeds.

In the next step 124, the print start instruction is provided to the printer unit 41. As a result, the printer unit 41 superimposes the variable data image based on the variable data on the image on the paper P on which the fixed data image based on the fixed data has been printed by the offset rotary press 20.

In the next step 126 during printing of the image based on the variable data by the printer unit 41, it is determined whether or not print operation instruction information has been input. The print operation instruction information in the exemplary embodiment is information for interfacing between printing operation of the offset printing unit 21 and printing operation of the printer device 40, e.g., information input from the offset control unit 86 such as rotary press stop information indicating a stop of printing of the offset rotary press 20. In case of negative determination, the processing goes to step 130.

On the other hand, if the print operation instruction information has been input, the determination is affirmative and the processing goes to step 128. In step 128, image forming by the printer unit 41 is stopped and only carriage of the paper P ejected from the offset rotary press 20 is carried out in the case of the above-described rotary press stop information. Then, the processing goes to step 130.

In step 130, it is determined whether or not forming of the variable data image based on the variable data is finished to finish the printing. Whether or not printing is finished is determined based on, for example, a finish instruction by the operator input from the operator panel 42 or a finish of forming of the predetermined number of images. In case of negative determination, the processing returns to step 126 where forming of the variable data image is continued. In case of affirmative determination, the processing goes to step 132. In step 132, printer stop information is output to the offset control unit 86 as the printing finish instruction and then the present processing ends.

Figure 6A:
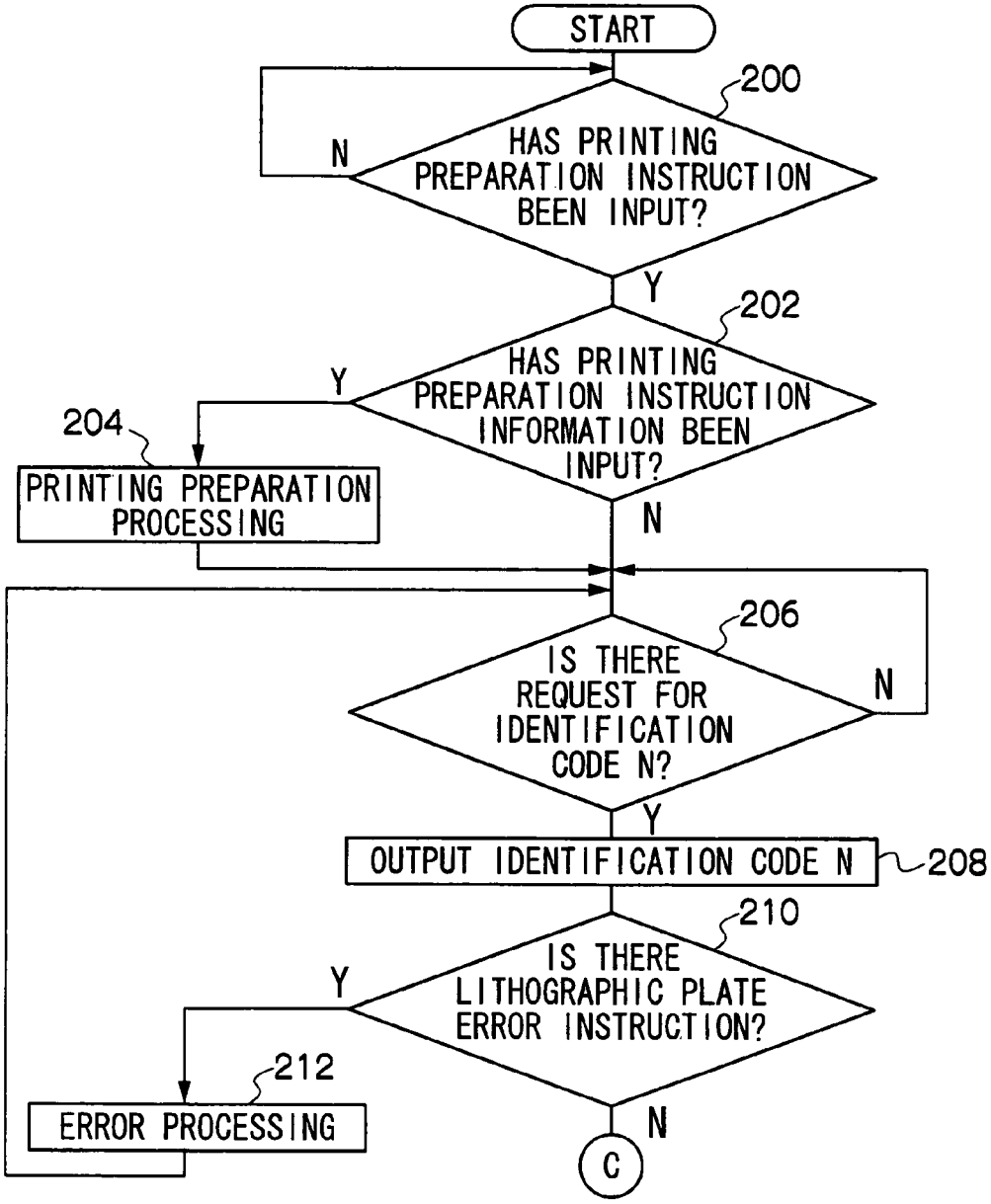
FIGS. 6A and 6B are flow charts of control processing performed by an offset control unit of the printing system according to the first exemplary embodiment of the present invention.
Figure 6B:
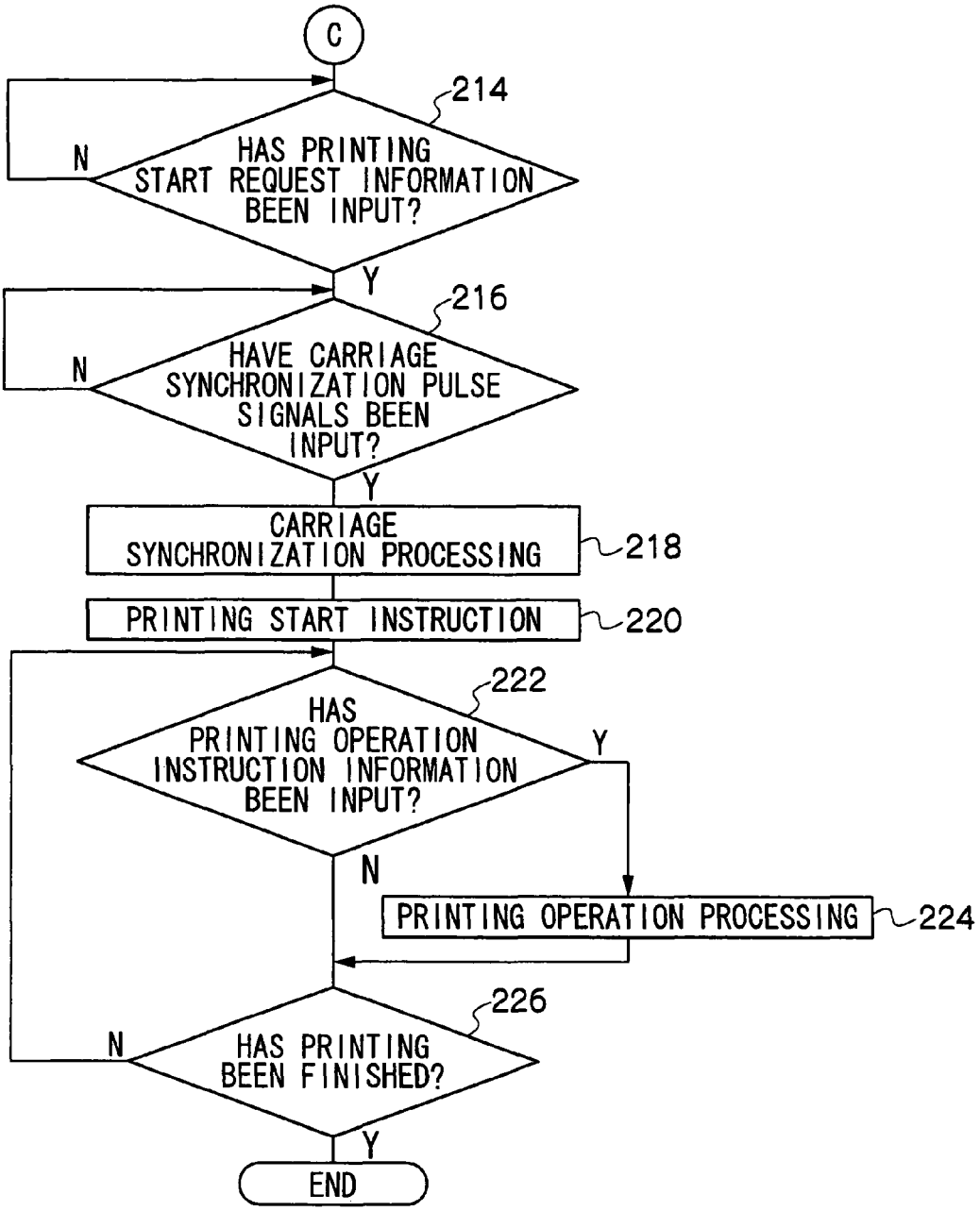

On the other hand, processing performed by the CPU in the offset control unit 86 is shown in FIGS. 6A and 6B. This processing flow chart is executed when the offset rotary press 20 is turned on, for example.

First, if an instruction is input to the offset control unit 86, it is determined in step 200 whether or not a printing preparation instruction (corresponding to step 102) has been input from the printer control unit 76. In case of negative determination, the processing comes into a standby state. If the instruction has been input, affirmative determination is made and the processing goes to step 202. In step 202, whether or not the printing preparation instruction information has been input is determined. The printing preparation instruction information in the exemplary embodiment is information for preparation for image forming by the offset printing unit 21 and for interfacing between the printing operation of the offset printing unit 21 and the printing operation of the printer device 40. For example, there are pieces of information input from the operator panel 22 and including ready switch information about whether or not the printing preparation has been finished (ready or not ready) based on conditions of the offset rotary press 20 such as a paper jam and running out of paper and printing mode switch information indicating whether a mode is a test printing mode or a normal printing mode. There are also pieces of information input from the printer control unit 76 and including operator panel key operation information for allowing operation of the operator panel 42 to be carried out on the operator panel 22 and instruction information for displaying the identification code M in the job data input to the printer device 40 on the operator panel. In case of negative determination, the processing goes to step 206.

On the other hand, if the printing preparation information is input, the affirmative determination is made and the processing goes to step 204. In step 204, the processing goes to step 206 in case of ready and is on standby until the not-ready state turns into the ready state in case of not ready if the information is the ready switch information. If the information is the printing mode switch information, the printing mode switch information is output to the printer control unit 76 and then the processing goes to step 206 in case of the normal printing mode. In case of the test printing mode, predetermined test printing operation is performed and then the processing goes to step 206. Moreover, if the identification code M in the job data is input, the identification code M is displayed on the operator panel 22 and then the processing goes to step 206.

In the next step 206, it is determined whether or not an instruction for requesting the identification code N of the lithographic plates 26 currently set in the offset rotary press 20 has been input from the printer control unit 76. In case of negative determination, the processing comes into the standby state. In case of affirmative determination (corresponding to step 112), the identification code N provided to the lithographic plates 26 is read by a sensor or the like, and mounted lithographic plate identification code information indicating the read identification code N is output to the printer control unit 76 in the next step 208 in the exemplary embodiment.

In the next step 210, whether or not printing error processing instruction (corresponding to step 116) has been input is determined. In case of affirmative determination, the processing goes to step 212 where a display to the effect that the identification code is different, for example, is produced on the operator panel 22 and then the processing returns to step 206. In case of negative determination, the processing goes to step 214 where it is determined whether or not printing start request information (corresponding to step 120) has been input from the printer control unit 76. In case of negative determination, the processing comes into the standby state. In case of affirmative determination, the processing goes to step 216.

In step 216, whether or not carriage synchronization pulse signals (corresponding to step 122) have been input from the printer control unit 76 is determined. In case of negative determination, the processing comes into the standby state. In case of affirmative determination, processing for synchronizing carriage is performed in the next step 218. In other words, a carrying speed of the paper P and the printing speed of the fixed data image based on the fixed data by the offset printing unit 21 are equalized with each other based on the input pulse signals.

In the next step 220, the printing start instruction is provided to the offset printing unit 21. As a result, the offset printing unit 21 prints the fixed data image based on the fixed data on the paper P.

In the next step 222 during printing of the image based on the fixed data by the offset printing unit 21, whether or not the printing operation instruction information has been input is determined. The printing operation instruction information in the exemplary embodiment is information for interfacing between printing operation of the offset printing unit 21 and printing operation of the printer device 40, e.g., information input from the printer control unit 76 such as printer stop information indicating a stop of image forming by the printer device 40. In case of negative determination, the processing goes to step 226.

On the other hand, if the printing operation instruction information has been input, the determination is affirmative and the processing goes to step 224. In step 224, a predetermined stop sequence (predetermined processing for stopping the rotary press) is performed in a case of the above-described printer stop information, for example, and then the processing goes to step 226.

In step 226, it is determined whether or not printing of the image based on the fixed data is finished. Whether or not printing is finished is determined based on, for example, a finish instruction by the operator and input from the operator panel 42, a finish of forming of the predetermined number of images, and the printer stop information (corresponding to step 132) input from the printer control unit 76. In case of negative determination, the processing returns to step 222 where printing of the fixed data image is continued. In case of affirmative determination, the present processing ends.

As described above, the processing flow chart shown in FIGS. 5A and 5B is performed by the printer control unit 76 of the printer device 40 and the processing flow chart show in FIGS. 6A and 6B is performed by the offset control unit 86 of the offset rotary press 20. This enables to print on the paper P a final image formed by superimposing the fixed data image based on the fixed data and the variable data image based on the variable data on each other.

The offset printing unit 21 and the printer unit 41 are controlled in such a manner as to carry out printing when the identification code N of the lithographic plates 26 and the identification code M corresponding to the variable data agree with each other in the exemplary embodiment. However, if there are a plurality of identification codes of the variable data corresponding to the identification code N, correspondence between them may be stored in advance in the storage unit 74 or the like to carry out printing based on the correspondence.

Although the printer control unit 76 provides the printing operation instruction for the offset rotary press 20 to the offset control unit 86 in the exemplary embodiment, this is not absolutely necessary. It is also possible that the offset control unit 86 provides the printing operation instruction for the printer device 40 to the printer control unit 76.

Moreover, although the offset rotary press 20 is provided on the upstream side in the carrying direction of the paper P and the printer device 40 is provided on the downstream side in the exemplary embodiment, their positions may be reversed. Because it is preferable that the printer device 40 carries out page alignment (registration of the variable data image to be superposed on the fixed data image formed by the offset rotary press 20), the offset rotary press 20 is preferably disposed on the upstream side.

Second Exemplary Embodiment

Figure 8:
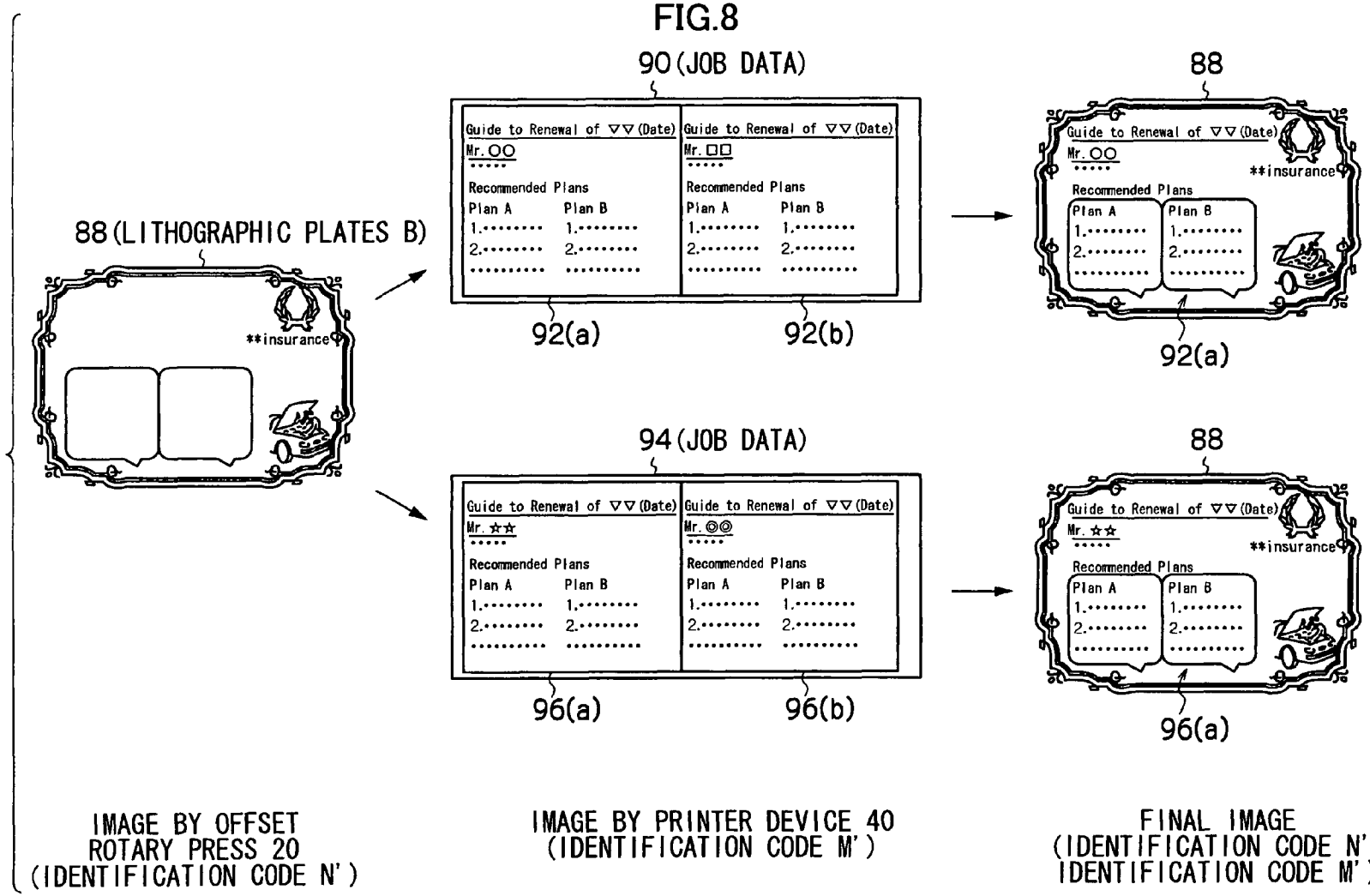
FIG. 8 is an explanatory view for explaining an example of a final image formed by overlapping a fixed data image based on fixed data and a variable data image based on variable data on each other according to the exemplary embodiment of the present invention.

In a second exemplary embodiment, description will be given to a case where the storage unit 74 can store plural items of job data and the plural items of job data received by the receiving unit 72 of the printer device 40 are stored in the storage unit 74. For example, this is a case where job data 80, job data 84, job data 90, and job data 94 are stored, for example (FIGS. 7 and 8). In this case, printing can be normally carried out in a printing order defined by the printer device 40 and the like such as an order in which the items of job data have been input to the printer device 40. In the exemplary embodiment, a case where the printing order is changed according to the lithographic plates 26 set currently will be described.

Since the exemplary embodiment has substantially the same configuration as the first exemplary embodiment, the same components are provided with the same reference numerals to omit detailed description of the components.

Figure 9A:
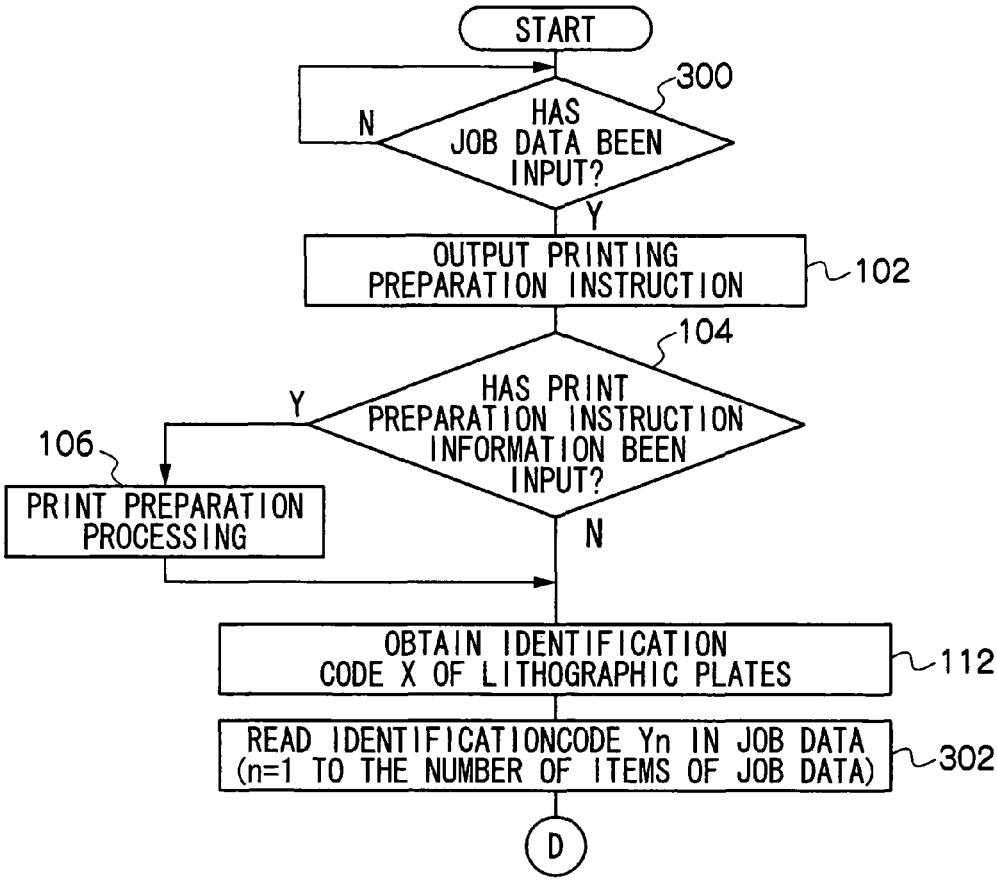
FIGS. 9A and 9B are flow charts of control processing performed by a printer control unit of a printing system according to a second exemplary embodiment of the present invention.
Figure 9B:
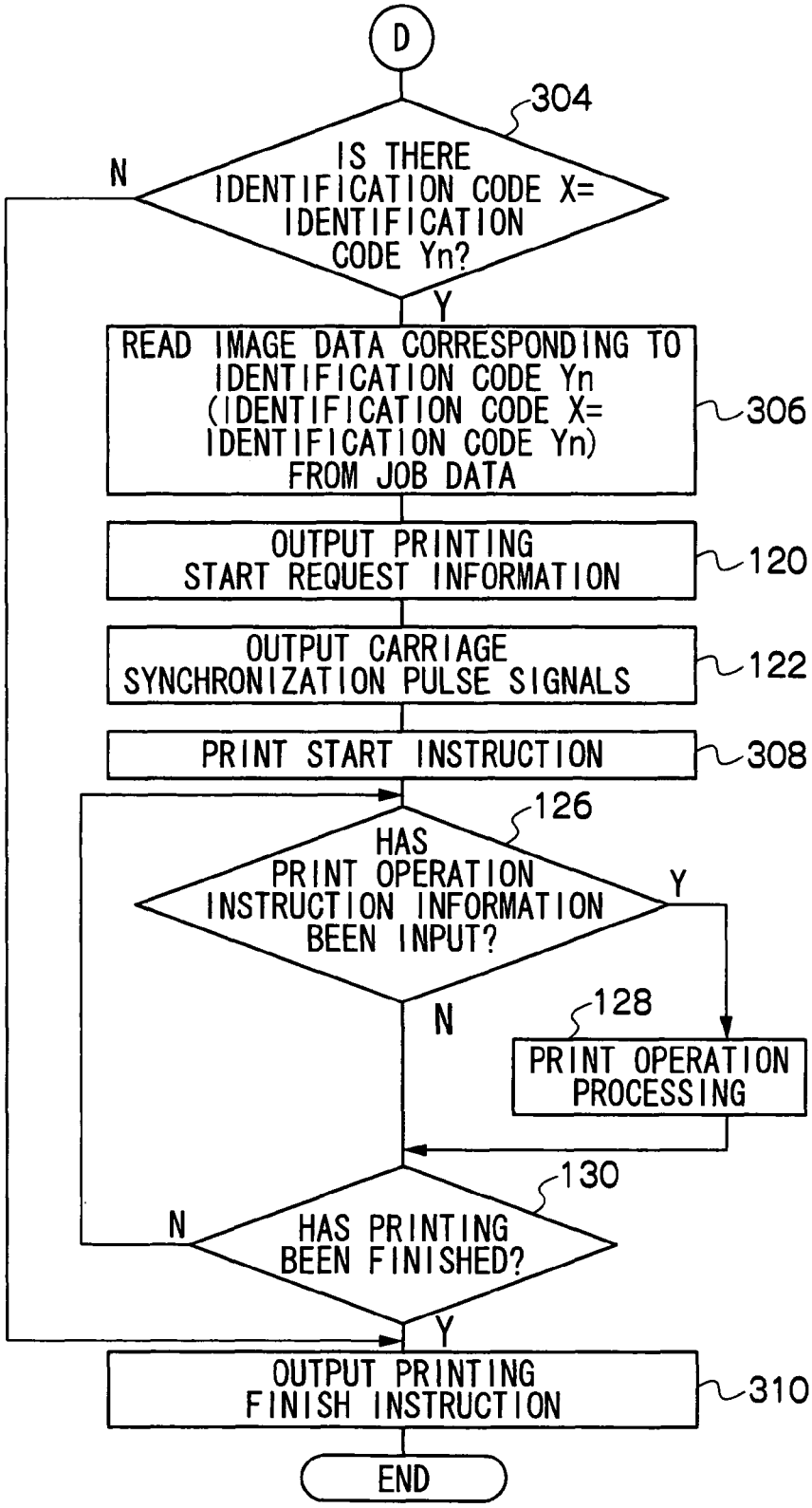

A control routine executed in the printing system 10 of the exemplary embodiment will be described with reference to the drawings. The processing shown in FIGS. 9A and 9B is processing performed by the CPU of the printer control unit 76 and is performed when the printer device 40 is turned on or the receiving unit 72 receives the job data output from the host device 70, for example.

If an instruction is input to the printer control unit 76, it is determined in step 300 whether or not at least one or more items of job data have been input from the host device 70. In case of negative determination, the processing comes into the standby state and the job data is received by the receiving unit 72. When one or more items of job data are stored in the storage unit 74, the affirmative determination is made and the processing goes to step 102. In step 102, a printing preparation instruction is output to the offset control unit 86 and the processing goes to step 104. Similarly to the first exemplary embodiment, pieces of processing in steps 104, 106, and 112 are performed.

In the next step 302, an identification code Yn (n=1 to the number of items of job data stored, 4 in the exemplary embodiment) in at least one or more (4 in the exemplary embodiment) items of job data stored in the storage unit 74 is obtained.

In the next step 304, it is determined whether or not there is any code in the identification codes Yn that agrees with the identification code X of the lithographic plates 26 currently set in the offset rotary press 20, the identification code X being obtained in step 112. In case of negative determination, the processing goes to step 310. If there is any code that agrees, on the other hand, affirmative determination is made and the processing goes to step 306. In case of the exemplary embodiment, if an identification code X of the lithographic plates 26 currently set in the offset rotary press 20 is equal to an identification code N (identification code of lithographic plates A for printing the fixed data image 78), the identification code agrees with the identification code M included in the job data 80 and the job data 84. If the identification code X is equal to an identification code N' (identification code of lithographic plates B for printing the fixed data image 88), the identification code agrees with an identification code M' included in the job data 90 and the job data 94.

In the next step 306, the image data (variable data) corresponding to the identification code Yn (the identification code X=the identification code Yn) is read from the job data. If the plurality of identification codes Yn agree with the identification code X as in the above-described exemplary embodiment, an arbitrary order such as an order in which the codes have been input to the printer device 40 is selected, the corresponding job data is read, and pieces of processing in steps 120 and 122 are performed.

In the next step 308, an instruction to start image forming of the image data read in step 306 is provided to the printer unit 41.

Furthermore, after pieces of processing in steps 126, 128, and 130, the processing goes to step 310. In step 310, in case of negative determination in step 304, processing for instructing to finish the printing is performed in addition to the above-described processing in step 132, and the present processing is ended.

Figure 10A:
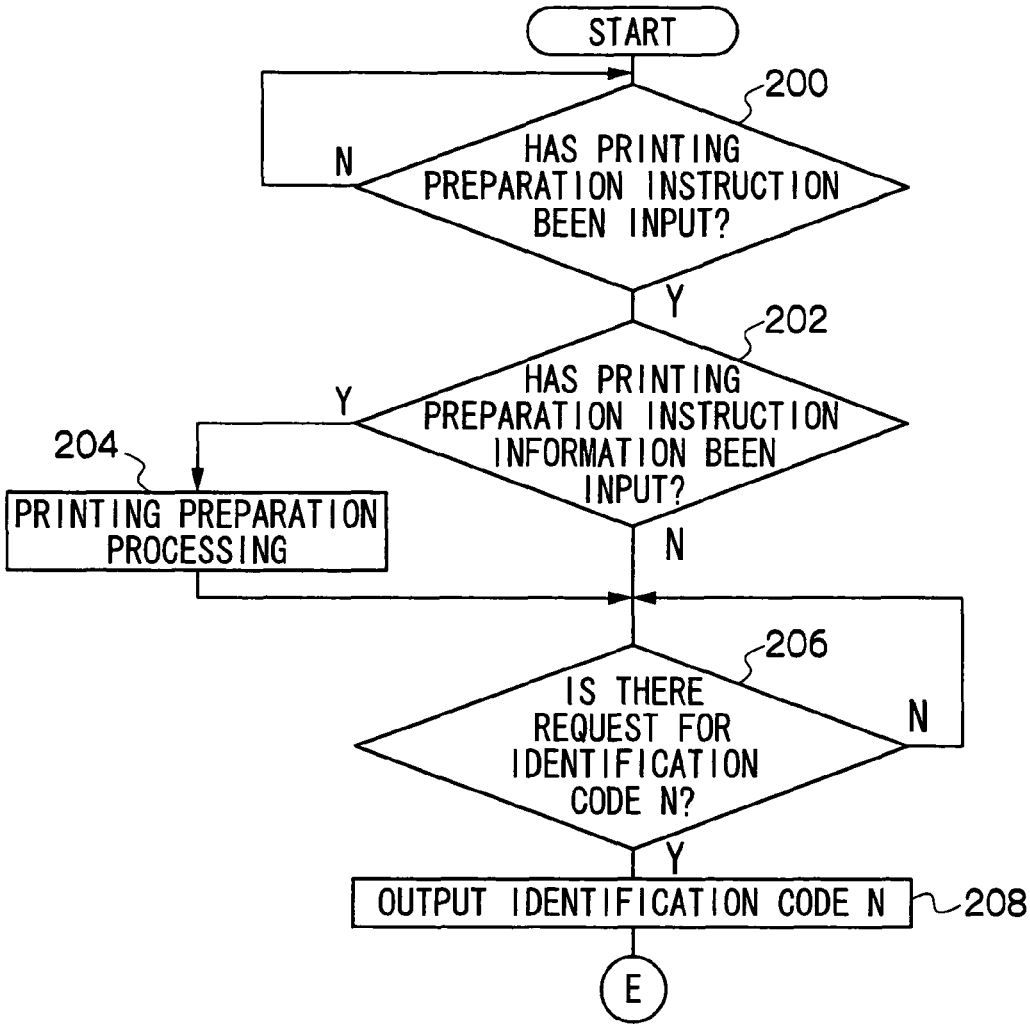
FIGS. 10A and 10B are flow charts of control processing performed by an offset control unit of the printing system according to the second exemplary embodiment of the present invention.
Figure 10B:
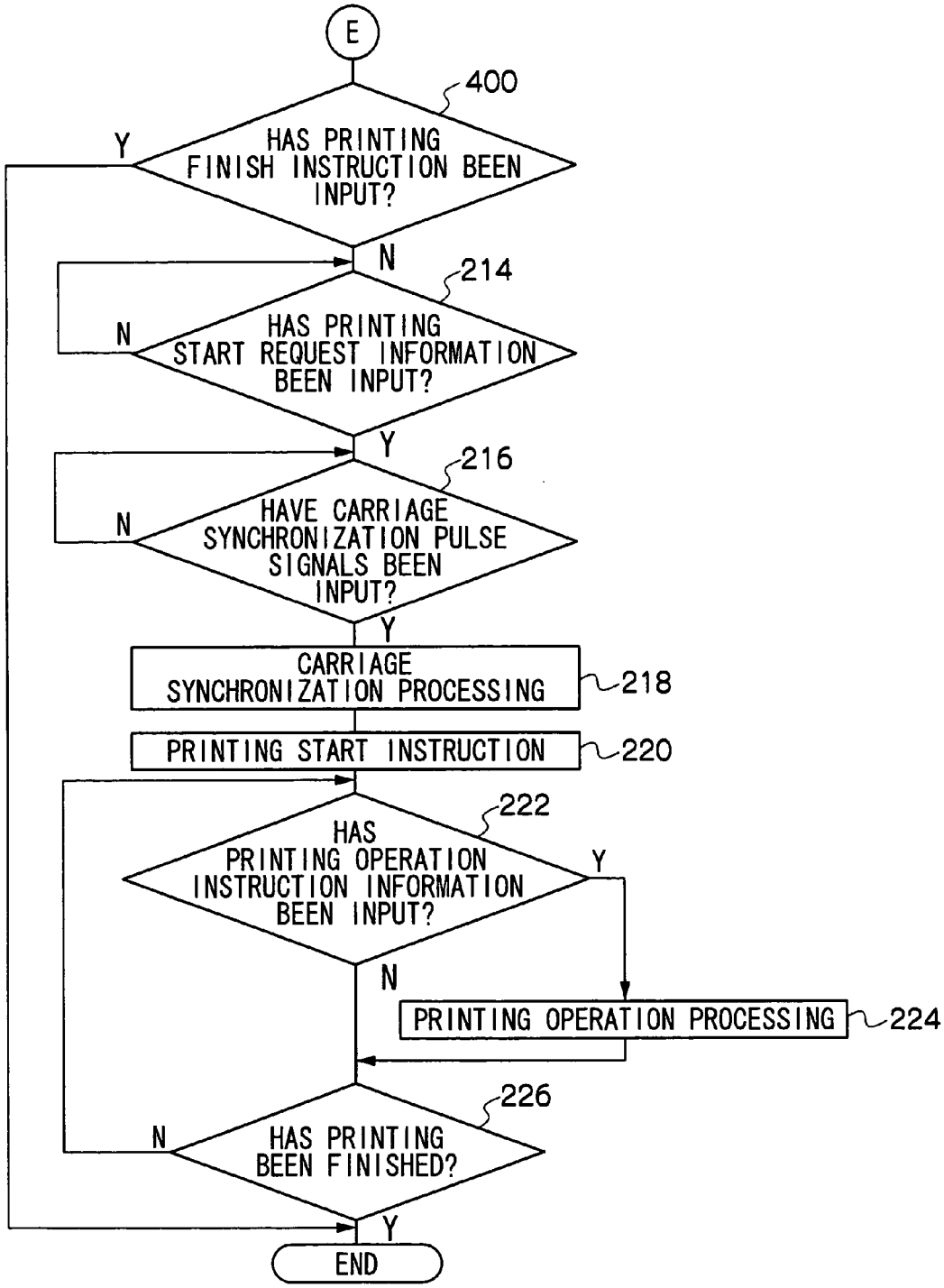

On the other hand, FIGS. 10A and 10B show processing performed by the CPU in the offset control unit 86. This processing flow chart is performed when the offset rotary press 20 is turned on, for example.

First, if an instruction is input to the offset control unit 86, the processing goes to step 200 and pieces of processing in steps 200, 202, 204, 206, and 208 are performed.

In the next step 400, whether or not a printing finish instruction has been input is determined. In case of negative determination in step 304, the printing finish instruction is input in step 310 and therefore affirmative determination is made to end the present processing. In case of negative determination, on the other hand, the processing goes to step 214 and the present processing is ended after performing pieces of processing of steps 214 to 226.

Although the printing processing by the present printing system is finished if the identification code in the job data, read by the printer control unit 76 of the printer device 40, and the identification code obtained from the offset control unit 86 do not agree with each other in the exemplary embodiment, this is not absolutely necessary. It is also possible that the identification code in the job data, read by the printer control unit 76, is displayed on the operator panel 22 of the offset rotary press 20 to prompt the operator to change the lithographic plates 26, for example.

In this way, the processing flow chart shown in FIGS. 9A and 9B is performed by the printer control unit 76 of the printer device 40 and the processing flow chart shown in FIGS. 10A and 10B is performed by the offset control unit 86 of the offset rotary press 20. This enables to print the final image formed by superimposing the fixed data image and the variable data image based on the variable data on each other, the fixed data image being formed by using the lithographic plates 26 currently set in the offset rotary press 20.

A first aspect of the invention includes: a lithographic plate information printing unit for printing lithographic plate information on a recording medium by using a lithographic plate; a variable information printing unit for printing predetermined variable information on the recording medium on which the lithographic plate information is printed by the lithographic plate information printing unit; and a control component for carrying out a control so that the lithographic plate information to be printed by the lithographic plate information printing unit and the variable information to be printed by the variable information printing unit are printed in preset correspondence with each other.

A second aspect of the invention includes, in the first aspect, a determination component for determining whether or not the lithographic plate information to be printed by the lithographic plate information printing unit and the variable information to be printed by the variable information printing unit are in the preset correspondence with each other, in which the control component controls printing operation of the lithographic plate information printing unit and the variable information printing unit based on a result of determination by the determination component.

In a third aspect of the invention, the control component of the second aspect allows the printing operation of the lithographic plate information printing unit and the variable information printing unit when the determination component determines that the lithographic plate information to be printed by the lithographic plate information printing unit and the variable information to be printed by the variable information printing unit are in the preset correspondence with each other.

In a fourth aspect of the invention, the control component of the second aspect or the third aspect restricts the printing operation of the lithographic plate information printing unit and the variable information printing unit when the determination component determines that the lithographic plate information to be printed by the lithographic plate information printing unit and the variable information to be printed by the variable information printing unit are not in the preset correspondence with each other.

In a fifth aspect of the invention, the control component of any one of the second to fourth aspects gives notice that the lithographic plate information to be printed by the lithographic plate information printing unit and the variable information to be printed by the variable information printing unit are not in the preset correspondence with each other or that the lithographic plate information to be printed by the lithographic plate information printing unit and the variable information to be printed by the variable information printing unit are in the preset correspondence with each other based on the result of determination by the determination component.

A sixth aspect of the invention includes, in any one of the second to fifth aspects: a storage component capable of storing a plurality of pieces of variable information; and a printing order changing component for changing a printing order of the plurality of pieces of variable information stored in the storage component, in which the control component controls the printing order changing component based on the result of determination by the determination component.

A seventh aspect of the invention includes, in any one of the second to sixth aspects: a first obtaining component for obtaining first identification information provided in advance to the lithographic plate disposed in the lithographic plate information printing unit; and a second obtaining component for obtaining second identification information provided in advance to the variable information, in which the determination component determines whether or not the lithographic plate information to be printed by the lithographic plate information printing unit and the variable information to be printed by the variable information printing unit are in the preset correspondence with each other based on the first identification information obtained by the first obtaining component and the second identification information obtained by the second obtaining component.

In an eighth aspect of the invention, the determination component of the seventh embodiment determines whether or not the first identification information provided in advance to the lithographic plate disposed in the lithographic plate information printing unit and second identification information provided in advance to the variable information printing unit are the same as each other.

A ninth aspect of the invention includes, in the first aspect: a storage component capable of storing a plurality of pieces of variable information; and an obtaining component for obtaining identification information provided in advance to the lithographic plate disposed in the lithographic plate information printing unit, in which the control component selects variable information to which the same identification information as the identification information obtained by the obtaining component from the plurality of pieces of variable information stored in the storage component and provides an instruction for printing operation based on the selected variable information to the variable information printing unit.

A tenth aspect of the invention includes: a lithographic plate information printing unit for printing lithographic plate information on a recording medium by using a lithographic plate; and a control component for carrying out a control so that the lithographic plate information to be printed by the lithographic plate information printing unit and variable information to be printed by a variable information printing unit for printing predetermined variable information on the recording medium on which the lithographic plate information is printed by the lithographic plate information printing unit are printed in preset correspondence with each other.

An eleventh aspect of the invention includes: a variable information printing unit for printing predetermined variable information on the recording medium on which lithographic plate information is printed by a lithographic plate information printing unit for printing the lithographic plate information on the recording medium by using a lithographic plate; and a control component for carrying out a control so that the lithographic plate information to be printed by the lithographic plate information printing unit and variable information to be printed by the variable information printing unit are printed in preset correspondence with each other.

A twelfth aspect of the invention includes: a control component for carrying out a control so that lithographic plate information to be printed by a lithographic plate information printing unit for printing the lithographic plate information on a recording medium by using a lithographic plate and variable information to be printed by a variable information printing unit for printing predetermined variable information on the recording medium on which the lithographic plate information is printed by the lithographic plate information printing unit are printed in preset correspondence with each other.

A thirteenth aspect of the invention causes a computer to execute processing including the steps of: causing a lithographic plate information printing unit to print lithographic plate information on a recording medium by using a lithographic plate; causing a variable information printing unit to print predetermined variable information on the recording medium on which the lithographic plate information is printed by the lithographic plate information printing unit; and carrying out a control so that the lithographic plate information to be printed by the lithographic plate information printing unit and the variable information to be printed by the variable information printing unit are printed in preset correspondence with each other.

What is claimed is:

1. A printing system comprising:

a lithographic plate information printing unit that prints lithographic plate information on a recording medium using a lithographic plate;

a variable information printing unit that prints predetermined variable information on the recording medium on which the lithographic plate information is printed by the lithographic plate information printing unit;

a first obtaining component that obtains first identification information provided in advance to the lithographic plate disposed in the lithographic plate information printing unit;

a storage unit that stores second identification information associated with the variable information;

a determination component that determines whether the lithographic plate information to be printed by the lithographic plate information printing unit and the variable information to be printed by the variable information printing unit are in a preset corresponding relationship, based on the first identification information obtained by the first obtaining component and the second identification information stored in the storage unit, wherein the determination component determines whether the lithographic plate information and the variable information are in the preset corresponding relationship after a print instruction is input to an operator panel to initiate printing; and a control component that, if determined that the lithographic plate information to be printed by the lithographic plate information printing unit and the variable information to be printed by the variable information printing unit are in the preset corresponding relationship, then, based on a result of determination by the determination component, controls so that the lithographic plate information to be printed by the lithographic plate information printing unit and the variable information to be printed by the variable information printing unit are printed in the preset corresponding relationship, and in a case that the determination component determines that the lithographic plate information to be printed by the lithographic plate information printing unit and the variable information to be printed by the variable information printing unit are not in the preset corresponding relationship, controls so that printing is not performed.

2. The printing system of claim 1, wherein the control component allows a printing operation of the lithographic plate information printing unit and the variable information printing unit when the determination component determines that the lithographic plate information to be printed by the lithographic plate information printing unit and the variable information to be printed by the variable information printing unit are in the preset corresponding relationship.

3. The printing system of claim 1, wherein the control component restricts a printing operation of the lithographic plate information printing unit and the variable information printing unit when the determination component determines that the lithographic plate information to be printed by the lithographic plate information printing unit and the variable information to be printed by the variable information printing unit are not in the preset corresponding relationship.

4. The printing system of claim 1, wherein the control component gives notice that the lithographic plate information to be printed by the lithographic plate information printing unit and the variable information to be printed by the variable information printing unit are not in the preset corresponding relationship or that the lithographic plate information to be printed by the lithographic plate information printing unit and the variable information to be printed by the variable information printing unit are in the preset corresponding relationship based on the result of the determination by the determination component.

5. The printing system of claim 1 further comprising:

a storage component that stores a plurality of pieces of variable information; and a printing order changing component that changes a printing order of the plurality of pieces of variable information stored in the storage component, wherein the control component controls the printing order changing component based on the result of the determination by the determination component.

6. The printing system of claim 1 further comprising:

a second obtaining component that obtains second identification information provided in advance to the variable information, wherein the determination component determines whether the lithographic plate information to be printed by the lithographic plate information printing unit and the variable information to be printed by the variable information printing unit are in the preset corresponding relationship based on the first identification information obtained by the first obtaining component and the second identification information obtained by the second obtaining component.

7. The printing system of claim 6, wherein the determination component determines whether the first identification information provided in advance to the lithographic plate disposed in the lithographic plate information printing unit and the second identification information provided in advance to the variable information printing unit are the same as each other.

8. The printing system of claim 1 further comprising:

a storage component that stores a plurality of pieces of variable information, wherein the control component selects variable information that has attached thereto identification information that is the same as the first identification information obtained by the first obtaining component from the plurality of pieces of variable information stored in the storage component, and provides to the variable information printing unit an instruction for a printing operation based on the selected variable information.

9. The printing system of claim 1, wherein the control component controls so that the printing system goes into a standby state, if determined that the lithographic plate information to be printed by the lithographic plate information printing unit and the variable information to be printed by the variable information printing unit are not in the preset corresponding relationship.

10. The printing system of claim 1, wherein the control component controls so that an error message is displayed on the operator panel, if determined that the lithographic plate information to be printed by the lithographic plate information printing unit and the variable information to be printed by the variable information printing unit are not in the preset corresponding relationship.

11. A printing device comprising:

a lithographic plate information printing unit that prints lithographic plate information on a recording medium using a lithographic plate; and a control component that, if determined that the lithographic plate information to be printed by the lithographic plate information printing unit and a variable information to be printed by a variable information printing unit are in a preset corresponding relationship, then, based on a result of determination by a determination component, controls so that the lithographic plate information to be printed by the lithographic plate information printing unit and the variable information to be printed by the variable information printing unit that prints predetermined variable information on the recording medium on which the lithographic plate information is printed by the lithographic plate information printing unit, are printed in the preset corresponding relationship, and in a case that the determination component determines that the lithographic plate information to be printed by the lithographic plate information printing unit and the variable information to be printed by the variable information printing unit are not in the preset corresponding relationship, controls so that printing is not performed, wherein the determination component determines whether the lithographic plate information to be printed by the lithographic plate information printing unit and the variable information to be printed by the variable information printing unit are in the preset corresponding relationship, based on first identification information provided in advance to the lithographic plate disposed in the lithographic plate information printing unit and obtained by a first obtaining component, and second identification information associated with the variable information and stored in a storage unit, and the determination component determines whether the lithographic plate information and the variable information are in the preset corresponding relationship after a print instruction is input to an operator panel to initiate printing.

12. A printing device comprising:

a variable information printing unit that prints predetermined variable information on a recording medium on which lithographic plate information is printed by a lithographic plate information printing unit for printing the lithographic plate information on the recording medium using a lithographic plate; and a control component that, if determined that the lithographic plate information to be printed by the lithographic plate information printing unit and the variable information to be printed by the variable information printing unit are in a preset corresponding relationship, then, based on a result of determination by a determination component, controls so that the lithographic plate information to be printed by the lithographic plate information printing unit and the variable information to be printed by the variable information printing unit are printed in the preset corresponding relationship, and in a case that the determination component determines that the lithographic plate information to be printed by the lithographic plate information printing unit and the variable information to be printed by the variable information printing unit are not in the preset corresponding relationship, controls so that printing is not performed, wherein the determination component determines whether the lithographic plate information to be printed by the lithographic plate information printing unit and the variable information to be printed by the variable information printing unit are in the preset corresponding relationship, based on first identification information provided in advance to the lithographic plate disposed in the lithographic plate information printing unit and obtained by a first obtaining component, and second identification information associated with the variable information and stored in a storage unit, and wherein the determination component determines whether the lithographic plate information and the variable information are in the preset corresponding relationship after a print instruction is input to an operator panel to initiate printing.

13. A controller comprising:

a control component that, if determined that a lithographic plate information to be printed by a lithographic plate information printing unit and a variable information to be printed by a variable information printing unit are in a preset corresponding relationship, then, based on a result of determination by a determination component, controls so that the lithographic plate information to be printed by the lithographic plate information printing unit for printing the lithographic plate information on a recording medium using a lithographic plate and the variable information to be printed by the variable information printing unit for printing predetermined variable information on the recording medium on which the lithographic plate information is printed by the lithographic plate information printing unit, are printed in the preset corresponding relationship, and in a case that the determination component determines that the lithographic plate information to be printed by the lithographic plate information printing unit and the variable information to be printed by the variable information printing unit are not in the preset corresponding relationship, controls so that printing is not performed, wherein the determination component determines whether the lithographic plate information to be printed by the lithographic plate information printing unit and the variable information to be printed by the variable information printing unit are in the preset corresponding relationship based on first identification information provided in advance to the lithographic plate disposed in the lithographic plate information printing unit and obtained by a first obtaining component, and second identification information associated with the variable information and stored in a storage unit, and wherein the determination component determines whether the lithographic plate information and the variable information are in the preset corresponding relationship after a print instruction is input to an operator panel to initiate printing.

14. A storage medium readable by a computer, the storage medium storing a program of instruction executable by the computer to perform a function for printing, the function comprising:

printing lithographic plate information on a recording medium using a lithographic plate;

printing predetermined variable information on the recording medium on which the lithographic plate information is printed;

obtaining first identification information provided in advance to the lithographic plate disposed in the lithographic plate information printing unit;

storing second identification information associated with the variable information;

determining, after a print instruction is input to an operator panel to initiate printing, whether the lithographic plate information to be printed by the lithographic plate information printing unit and the variable information to be printed by the variable information printing unit are in a preset corresponding relationship, based on the obtained first identification information and the stored second identification information; and controlling so that the lithographic plate information to be printed by the lithographic plate information printing unit and the variable information to be printed by the variable information printing unit are printed in the preset corresponding relationship, if determined that the lithographic plate information to be printed by the lithographic plate information printing unit and the variable information to be printed by the variable information printing unit are in the preset corresponding relationship, and in a case that it is determined that the lithographic plate information to be printed by the lithographic plate information printing unit and the variable information to be printed by the variable information printing unit are not in the preset corresponding relationship, controlling so that printing is not performed.

15. A printing method comprising:

printing lithographic plate information on a recording medium using a lithographic plate;

printing predetermined variable information on the recording medium on which the lithographic plate information is printed;

obtaining first identification information provided in advance to the lithographic plate disposed in the lithographic plate information printing unit;

storing second identification information associated with the variable information;

determining, after a print instruction is input to an operator panel to initiate printing, whether the lithographic plate information to be printed by the lithographic plate information printing unit and the variable information to be printed by the variable information printing unit are in a preset corresponding relationship, based on the obtained first identification information and the stored second identification information; and controlling so that the lithographic plate information to be printed by the lithographic plate information printing unit and the variable information to be printed by the variable information printing unit are printed in the preset corresponding relationship, if determined that the lithographic plate information to be printed by the lithographic plate information printing unit and the variable information to be printed by the variable information printing unit are in the preset corresponding relationship, and in a case that it is determined that the lithographic plate information to be printed by the lithographic plate information printing unit and the variable information to be printed by the variable information printing unit are not in the preset corresponding relationship, controlling so that printing is not performed.

* * * * *